US011591880B2

(12) United States Patent
Noui-Mehidi et al.

(10) Patent No.: US 11,591,880 B2
(45) Date of Patent: Feb. 28, 2023

(54) METHODS FOR DEPLOYMENT OF EXPANDABLE PACKERS THROUGH SLIM PRODUCTION TUBING

(71) Applicant: SAUDI ARABIAN OIL COMPANY, Dhahran (SA)

(72) Inventors: Mohamed Nabil Noui-Mehidi, Dhahran (SA); Jinjiang Xiao, Dhahran (SA); Wael O. Badeghaish, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 148 days.

(21) Appl. No.: 16/943,012

(22) Filed: Jul. 30, 2020

(65) Prior Publication Data

US 2022/0034187 A1 Feb. 3, 2022

(51) Int. Cl.
*E21B 33/127* (2006.01)
*E21B 36/04* (2006.01)

(52) U.S. Cl.
CPC ..... *E21B 33/127* (2013.01); *E21B 36/04* (2013.01)

(58) Field of Classification Search
CPC ..... E21B 33/1208; E21B 33/12; E21B 33/127
See application file for complete search history.

(56) References Cited

U.S. PATENT DOCUMENTS 2,784,790 A 3/1957 Boer et al.
3,054,455 A 9/1962 Keltner
3,460,618 A 8/1969 Blagg
3,502,037 A 3/1970 Pickard
3,578,083 A 5/1971 Anderson et al.
3,666,011 A 5/1972 Owens
4,436,166 A 3/1984 Hayatdavoudi et al.
4,768,590 A 9/1988 Sanford et al.
4,948,070 A 8/1990 Lyman
4,991,314 A 2/1991 Allen
5,274,006 A 12/1993 Kagoshima et al.
5,327,962 A 7/1994 Head
5,337,823 A 8/1994 Nobileau
(Continued)

FOREIGN PATENT DOCUMENTS

CN 2091349 U * 12/1991
EP 1081472 A2 3/2001
(Continued)

OTHER PUBLICATIONS

"Sika® PostFix: Easy-to-Prepare, Mix-in-the-Bag, Fast-Setting, Expanding Polyurethane Foam for Post Installation", Product Data Sheet, Sika, Version 01.03, Sep. 2018, URL: <https://usa.sika.com/dms/getdocument.get/74589bda-a8c6-42f9-b34c-b6636003628a/sika_postfix.pdf> (4 pages).
(Continued)

*Primary Examiner* — Zakiya W Bates
(74) *Attorney, Agent, or Firm* — Osha Bergman Watanabe & Burton LLP

(57) ABSTRACT

A method includes wrapping a packer bag around a deployment tool, providing at least one canister in fluid communication with the packer bag, sending the packer bag around the downhole tool to a downhole location in a well, and injecting a polymer filler material from the at least one canister into the packer bag until the packer bag expands to seal the downhole location.

9 Claims, 5 Drawing Sheets

(56) References Cited

U.S. PATENT DOCUMENTS

| | | | |
|---|---|---|---|
| 5,458,860 | A | 10/1995 | Morris et al. |
| 5,507,341 | A | 4/1996 | Eslinger et al. |
| 5,676,213 | A | 10/1997 | Auzerais et al. |
| 6,029,746 | A | 2/2000 | Dodd |
| 6,120,261 | A | 9/2000 | Al-Towailib |
| 6,446,717 | B1 | 9/2002 | White et al. |
| 6,508,305 | B1 | 1/2003 | Brannon et al. |
| 6,555,009 | B2 | 4/2003 | Varadaraj |
| 6,575,247 | B2 | 6/2003 | Tolman et al. |
| 6,598,675 | B2 | 7/2003 | Bussear et al. |
| 6,792,814 | B2 | 9/2004 | Dittman, Sr. |
| 6,832,655 | B2 | 12/2004 | Ravensbergen et al. |
| 6,894,083 | B2 | 5/2005 | Braun et al. |
| 6,978,828 | B1 | 12/2005 | Gunawardana |
| 7,211,550 | B2 | 5/2007 | Benton et al. |
| 7,258,169 | B2 | 8/2007 | Fripp et al. |
| 7,263,836 | B2 | 9/2007 | Gunawardana et al. |
| 7,320,367 | B2 | 1/2008 | Brezinski et al. |
| 7,431,098 | B2 | 10/2008 | Ohmer et al. |
| 7,470,330 | B2 | 12/2008 | Keatch |
| 7,677,320 | B2 | 3/2010 | Shaw et al. |
| 7,677,673 | B2 | 3/2010 | Tranquilla et al. |
| 7,743,825 | B2 | 6/2010 | O'Malley et al. |
| 7,963,172 | B2 | 6/2011 | Liu et al. |
| 2005/0098443 | A1 | 5/2005 | Gomez |
| 2005/0217860 | A1 | 10/2005 | Mack et al. |
| 2005/0263284 | A1 | 12/2005 | Justus |
| 2007/0224692 | A1 | 9/2007 | Agar et al. |
| 2009/0090502 | A1 | 4/2009 | Lumbye et al. |
| 2009/0090503 | A1 | 4/2009 | Groves |

FOREIGN PATENT DOCUMENTS

| | | | |
|---|---|---|---|
| ES | 2340022 | T3 | 5/2010 |
| WO | 2009/001069 | A2 | 12/2008 |
| WO | 2009018694 | A1 | 2/2009 |
| WO | 2012045771 | A2 | 4/2012 |

OTHER PUBLICATIONS

International Search Report and Written Opinion issued in corresponding International Patent Application No. PCT/US2020/054248, dated Mar. 10, 2021 (12 pages).

* cited by examiner

METHODS FOR DEPLOYMENT OF EXPANDABLE PACKERS THROUGH SLIM PRODUCTION TUBING

BACKGROUND

In downhole hydrocarbon recovery operations, a wellbore may be drilled to a reservoir of interest to recover hydrocarbons. As the wellbore is drilled, the wellbore wall may be cased with casing and/or lining to prevent wellbore wall collapse or damage. During drilling and/or completion stages of such operations, it may become necessary to seal or isolate portions of the well, which may be referred to as zonal isolation or well segmentation. For example, when drilling through formations having areas of water and sand, the annular area between the wellbore wall and a tubing string (e.g., casing or lining) may be sealed around the areas of water and sand to prevent interference with hydrocarbon recovery. Hydraulic fracturing is another example of when zonal isolation may be used to seal different sections of a well.

Depending on the area of the well to be isolated, the stage of completion of the well, and the purpose for well segmentation, a production packer or a service packer may be used to seal an annular space between a downhole tubing string (e.g., production tubing, lining string, or casing string) and the wall of the well (e.g., an open borehole wall in an uncased portion of the well or a casing wall in a cased portion of the well). Packers are typically designed to be sent downhole in a contracted configuration small enough to fit through the well to a selected downhole location, and when in the downhole location, the packer may radially expand to contact and seal around the well wall.

Inflatable packers are an example of a type of packer that have been used in the past to segment and seal off portions of a well. Inflatable packers are generally designed to radially expand when fluid is injected into the packer. However, inflatable packers may have expansion limits, which when reached, increase the likelihood of failure. Further, when deployed in portions of a wellbore having a sealing area near expansion limits of such inflatable packers, insufficient contact between the inflatable packer and the wellbore may lead to washout areas in the wellbore wall forming.

SUMMARY OF INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to methods of sealing a section of a well that includes wrapping a packer bag around a deployment tool, providing at least one canister in fluid communication with the packer bag, sending the packer bag around the downhole tool to a downhole location in a well, and injecting a polymer filler material from the at least one canister into the packer bag until the packer bag expands to seal the downhole location.

In another aspect, embodiments of the present disclosure relate to downhole tool assemblies that may include a deployment tool and a packer bag wrapped around an outer surface of the deployment tool, and at least one canister containing at least one polymer filler starting composition. The packer bag may include a flexible composite wall and a skeleton wire attached to the flexible composite wall and securing the packer bag around the deployment tool, wherein the flexible composite wall forms a fully enclosed bag having at least one fluid opening, and wherein the canister(s) is fluidly connected to the fluid opening(s).

Other aspects and advantages of the invention will be apparent from the following description and the appended claims.

DETAILED DESCRIPTION

Embodiments disclosed herein include inflatable packers that may be deployed through production tubing or other slim tubing to sit in larger cased or open hole wells. As used herein, a cased portion of a well may refer to a portion of a well having casing (extending from the surface of the well) or a liner (extending downhole from an end of a previously installed casing or liner) lining the well wall. The terms "open hole," "borehole," and "wellbore" may be used interchangeably and refer to an uncased portion of a well. Inflatable packers disclosed herein may be used to seal cased and/or open hole portions of a well.

For example, inflatable packers according to embodiments of the present disclosure may be used for zonal isolation and well segmentation along horizontal, vertical, or other directional portions of a well. In some embodiments, inflatable packers according to embodiments of the present disclosure may be used in well intervention services provided during and after the completion of a well. These services may include, for example, the stimulation of a targeted area or interval, as well as the removal of obstructions from the wellbore.

Inflatable packers of the present disclosure may be sent downhole in a deflated, flattened configuration as a packer bag. When deflated, the packer bag may be wrapped around the outer surface of a deployment tool and held around the deployment tool as the assembly is sent to a downhole location. Once in a selected downhole location, one or more canisters fluidly connected to the packer bag may inject a polymer filler material into the packer bag until the packer bag is fully inflated around the deployment tool.

Figure 1:
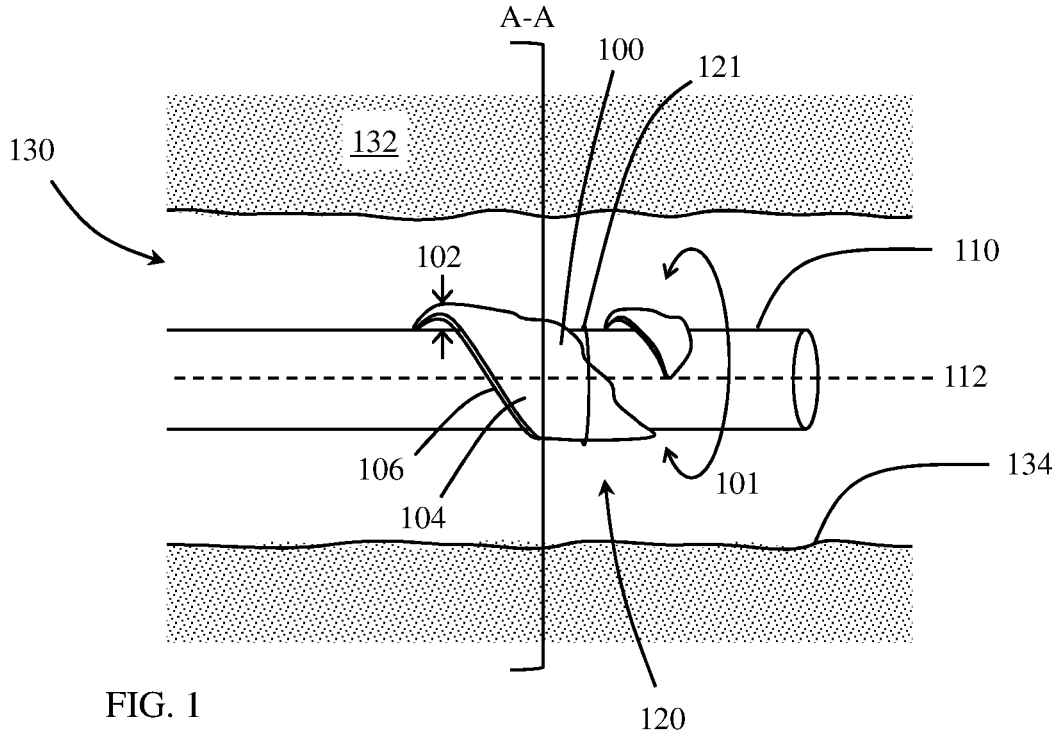
FIG. 1 shows a perspective view of a downhole tool assembly having a packer bag in a collapsed configuration according to embodiments of the present disclosure.
Figure 2:
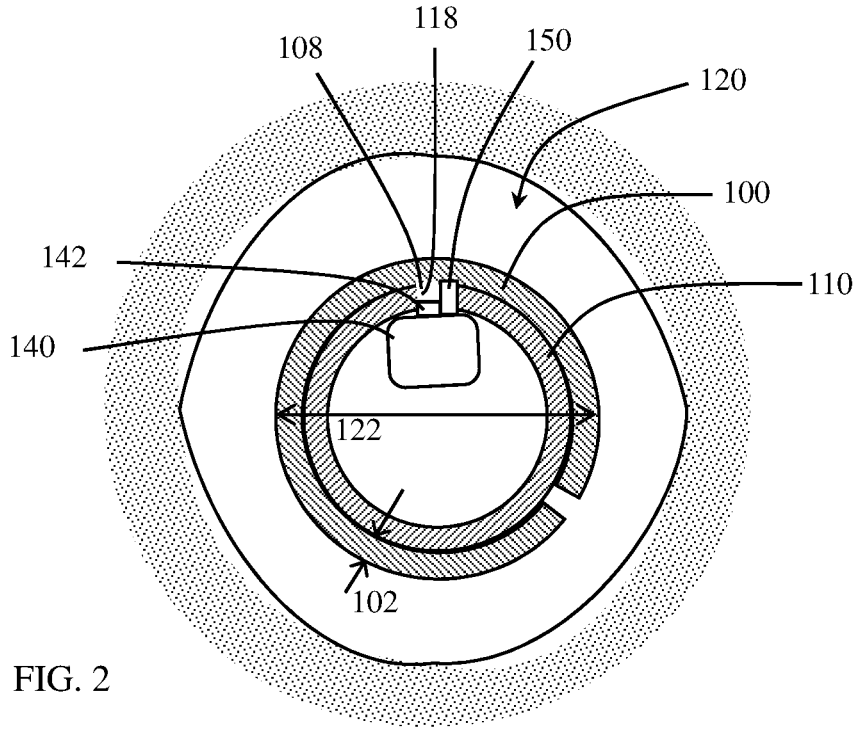
FIG. 2 shows a cross-sectional view of the downhole tool assembly as shown in FIG. 1.
Figure 3:
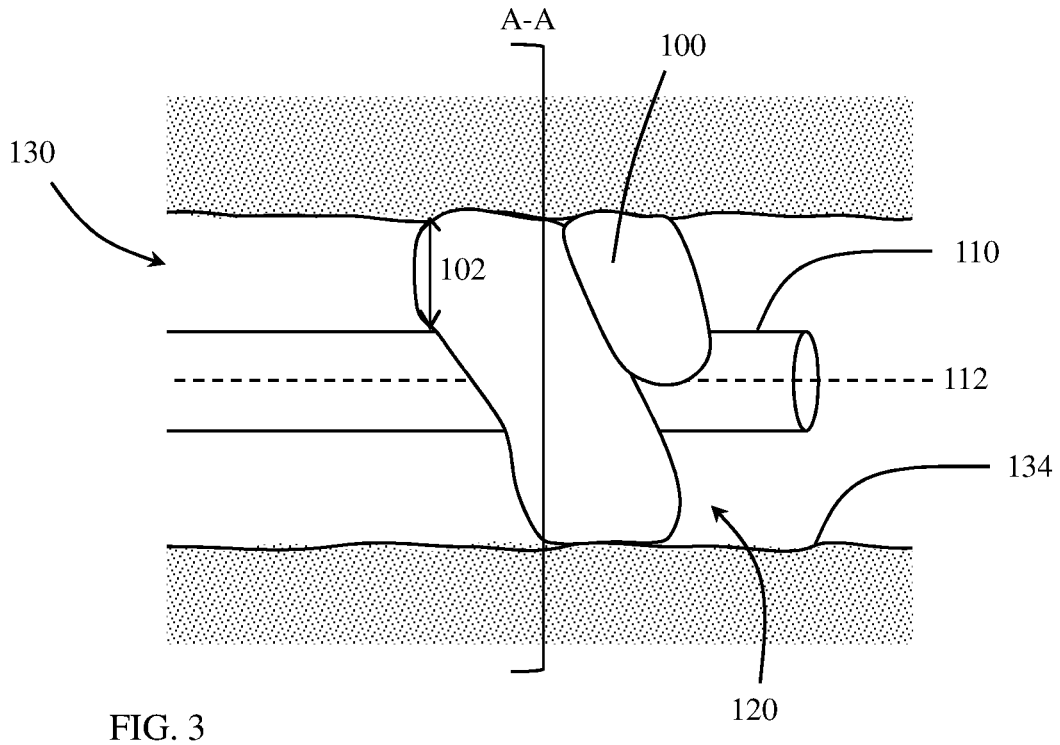
FIG. 3 shows a perspective view of the downhole tool assembly of FIG. 1, where the packer bag is in an inflated configuration, according to embodiments of the present disclosure.
Figure 4:
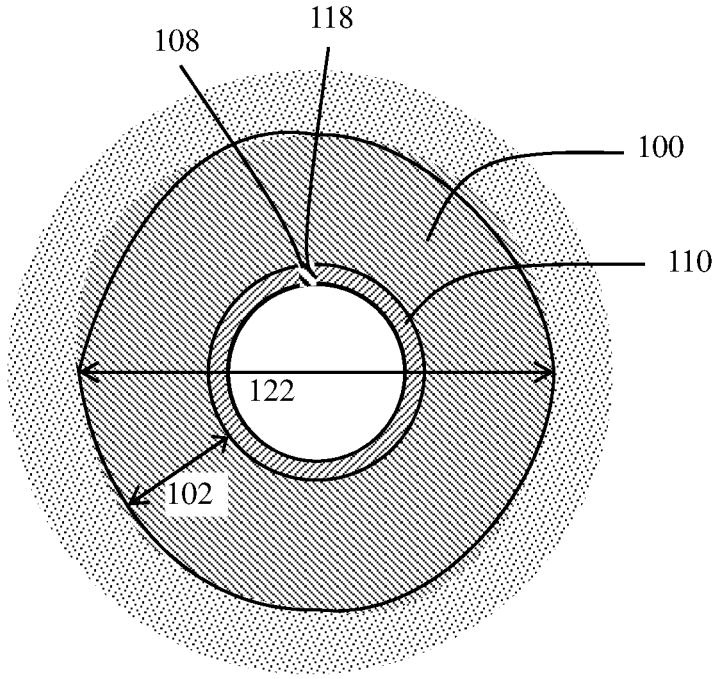
FIG. 4 shows a cross-sectional view of the downhole tool assembly as shown in FIG. 3.

FIGS. 1 and 2 show an example of a packer bag 100 in a deflated, flattened configuration wrapped helically around a deployment tool 110. As shown in FIG. 1, the packer bag 100 may be wrapped a circumferential distance 101 around the deployment tool 110 greater than a circumference of the deployment tool 110, e.g., ranging between 1.2 times and 1.5 times the circumference of the deployment tool 110, or greater than 1.5 times the circumference of the deployment tool 110. FIG. 2 shows a cross-sectional view of the downhole tool assembly 120 of FIG. 1 taken along plane A-A transverse to a longitudinal axis 112 of the deployment tool 110 when the packer bag 100 is in the collapsed, flattened configuration. FIGS. 3 and 4 show a perspective view and cross-sectional view, respectively, of the downhole tool assembly 120 of FIGS. 1 and 2 taken along plane A-A transverse to a longitudinal axis 112 of the deployment tool 110 when the packer bag 100 is in an expanded, fully inflated configuration.

The downhole tool assembly 120 may be sent to a downhole location in a well 130 formed through a formation 132 to seal an annular space between the deployment tool 110 and a borehole wall 134. In the embodiment shown, the packer bag 100 may be inflated to seal a section of an uncased, open hole section of a well 130, as shown in FIGS. 3 and 4. However, packer bags 100 according to embodiments of the present disclosure may similarly be used to seal cased sections of a well.

As shown in FIGS. 1 and 2, the packer bag 100 may be wound or wrapped around a deployment tool in a flattened configuration such that the packer bag 100 protrudes radially from an outer surface of the deployment tool 110 a maximum thickness 102. For example, when wrapped around the deployment tool in a flattened configuration, the flattened packer bag 100 may have a maximum thickness 102 extending radially from the deployment tool 110 that is less than 2 inches, less than 1 inch, less than 0.5 inches, or less than 0.3 inches. The packer bag 100 may be exposed (uncovered) to the well environment.

In the flattened configuration, the packer bag may be sent on the deployment tool 110 through slim tubing, such as production tubing having an inner diameter ranging between 4 and 6 inches, e.g., 4.5 inch inner diameter production tubing. For example, when wrapped around the deployment tool 110, the packer bag and deployment tool assembly 120 may have a maximum outer diameter 122, as measured between the wrapped packer bag around the deployment tool 110, ranging from less than 5.5 inches, less than 4.5 inches, or less than 4 inches. In some embodiments, the downhole tool assembly may have a maximum outer diameter 122 less than 3 inches. For example, the downhole tool assembly 120 may have a maximum outer diameter 122 less than 2.5 inches, such that it is capable of fitting through production tubing having an inner diameter of 2.5 inches.

The packer bag 100 may be formed of a flexible composite wall 104 and a skeleton wire 106 attached to the flexible composite wall 104. The flexible composite wall 104 may be formed of a flexible polymer composite that is flexible enough to withstand expansion from the collapsed, flattened configuration to a fully inflated configuration while also being strong enough to withstand aggressive downhole environments. For example, in some embodiments, a flexible composite wall 104 may be formed of a thermoplastic composite reinforced with aramid (e.g., Kevlar, Nomex, Technora, or Twaron fibers, or other heat-resistant and strong synthetic fibers comprising aromatic polyamides). In some embodiments, a flexible composite wall 104 may be formed of a thermoplastic polyurethane (TPU) material or other thermoplastic composite. For example, a filament-wound thermoplastic or thermosetting plastic material having a structural fibers (e.g., fiberglass or graphite fibers) impregnated therein may be used to form the flexible composite wall 104. In some embodiments, a flexible composite wall 104 may be formed of an elastomer.

The skeleton wire 106 may be integrated with the flexible composite wall 104 (e.g., embedded in the flexible composite wall) or attached to the flexible composite wall 104. The skeleton wire 106 may be a pliable and strong metallic wire that may tightly and securely wrap around the deployment tool 110 to hold the packer bag 100 to the deployment tool 110. For example, the skeleton wire 106 may be a metallic wire having a thickness ranging between 0.05 inches and 0.5 inches and a width of greater than 0.08 inches, greater than 0.1 inches, greater than 0.5 inches, or greater than 1 inch.

The packer bag 100 may be wrapped around a deployment tool 110 in a helix configuration, such as shown in FIG. 1, where the packer bag 100 spirals around the outer circumference of the deployment tool 110 along an axial length of the deployment tool 110. The packer bag 100 may be wrapped around the deployment tool 110 by positioning the skeleton wire 106 portion of the packer bag 100 proximate the outer surface of the deployment tool 110 and allowing the remaining flexible composite wall 104 of the packer bag 100 lay flat against skeleton wire 106 portion of the packer bag 100 and the outer surface of the deployment tool 110.

In some embodiments, one or more ties 121 releasably connected around the deployment tool 110 may be used to hold the flexible composite wall 104 in the flattened configuration as the downhole tool assembly 120 is sent downhole. In some embodiments, the tie(s) 121 may have a releasable connection that is released or broken from the force of the flexible composite wall 104 being inflated.

The packer bag 100 may have a flexible composite wall 104 that is large enough and flexible enough to expand from the flattened configuration into a larger cased or open hole portion of a well. For example, the packer bag 100 may expand to have a maximum outer diameter 122 greater than 6 inches, greater than 6.5 inches, greater than 7 inches, greater than 8 inches, or greater than 9 inches. Further, the packer bag may be designed to have an expansion ratio of greater than 2:1 or greater than 3:1, where an expansion ratio is the ratio of the outer diameter 122 of the packer bag in its fully expanded/inflated configuration, as shown in FIG. 4, to the outer diameter 122 of the packer bag in its fully retracted/flattened configuration, as shown in FIG. 2.

At a fully inflated size, the packer bag 100 may set firmly against the wall of the well (e.g., either a cased wall or an open borehole wall, such as in a sand-faced open hole). The size and shape of the flexible composite wall 104 may be pre-designed to fit within and seal a portion of a well. For example, when sealing a section of a well having an inner diameter, e.g., as measured between the casing in a cased portion of a well or between the borehole wall in an open hole portion of the well, the flexible composite wall 104 may be designed to have an inner diameter that fits around the deployment tool 110 used to deploy the packer bag 100, an outer diameter that is greater than or equal to the inner diameter of the portion of the well being sealed, and an axial length sufficient to ensure a good grip with the portion of the well being sealed. In some embodiments, a packer bag 100 may be designed to fit through a tubing string having an inner diameter of 4.5 inches or less (where the packer bag may be deployed on a deployment tool having an outer diameter less than the tubing string) and radially expand to and seal a well inner diameter of 6.5 inches or greater.

Further, the flexible composite wall 104 of the packer bag 100 may have an outer surface comprising a plurality of asperities. The asperities may provide a gripping surface which may grip to the wall of the portion of the well the inflatable packer is meant to seal. Further, asperities may be solidly formed of the wall flexible composite material throughout the entire height of the asperity, or asperities may form undulations on both the outer surface of the flexible composite wall 104 and the inner surface of the flexible composite wall 104. When asperities formed in the flexible composite wall 104 provide pores or undulations along the inner surface of the flexible composite wall 104, polymer filler material may fill and expand within the inner surface asperity pores when the polymer filler material is injected into the packer bag 100.

The asperities may vary in size, depending on, for example, if the asperities are to be filled in with polymer filler material or if the asperities are solid flexible composite material providing a rough gripping surface on the outer surface of the flexible composite wall 104. For example, asperities forming undulating outer and inner surfaces of the wall 104 (where the inner surface pores are to be filled in with polymer filler material) may have a relatively larger size than asperities providing a gripping outer surface and smooth inner surface of the wall 104. According to embodiments of the present disclosure, asperities may have a root diameter (the diameter of the asperity as measured at its root) ranging from a lower limit selected from 0.01 mm, 0.05 mm, 0.1 mm, and 0.5 mm to an upper limit selected from 0.1 mm, 0.5 mm, 0.8 mm, 1 mm, 2 mm, and 5 mm. In some embodiments, asperities may have a root diameter less than 0.01 mm. In some embodiments, asperities may have a root diameter ranging from a lower limit selected from 1 mm, 10 mm, and 25 mm to an upper limit selected from 10 mm, 25 mm, and 50 mm. Further, asperities may have a height protruding from the root of the asperity that is less than, equal to, or greater than the asperity width.

The flexible composite wall 104 may form a fully enclosed bag having at least one fluid opening 108. When wrapped around a deployment tool 110, the fluid opening(s) 108 in the packer bag 100 may be aligned with ports 118 through the deployment tool 110. The fluid opening(s) 108 may be held in an aligned positioned with the ports 118, for example, by tightly fitting the packer bag 100 around the deployment tool 110 in the align position or by attaching the fluid opening(s) 108 to the port(s) 118 (e.g., with a threaded connection, a latching mechanism, or the like).

A filler material source may be fluidly connected to the fluid opening(s) 108 via the port(s) 118 through the deployment tool 110. For example, as shown in FIG. 2, one or more canisters 140 may be positioned inside of the deployment tool 110, where a nozzle 142 on the canister 140 may fluidly connect to the port 118. The canister 140 may be filled with starting chemical compositions, which may be reacted together to form a polymer filler material. The starting chemical compositions may be mixed and/or reacted as they are injected into the packer bag 100 to fill and expand the packer bag 100 from a collapsed configuration, as shown in FIGS. 1 and 2, to an inflated configuration, as shown in FIGS. 3 and 4. The starting chemical composition(s) may be selected such that they expand and form the polymer filler material immediately (e.g., within 30 seconds, within 15 seconds, or within 5 seconds) upon being mixed and/or reacted.

In some embodiments, the canister 140 may be sent downhole with the deployment tool 110 on a separate running tool extending through a central bore in the deployment tool 110, where the canister 140 is fluidly connected to the fluid opening(s) 108 in the packer bag 100. A signal to inject the polymer filler material from the canister 140 into the packer bag 100 may be sent wirelessly or through a wired connection extending from the surface of the well through the running tool and to a release mechanism in the canister 140. After injection of the polymer filler material into the packer bag 100, the canister 140 may be disconnected from the deployment tool 110 and brought back to the surface of the well via the running tool, thereby leaving a central bore through the deployment tool 110 cleared of the canister(s) 140, as shown in FIG. 4.

In some embodiments, canister(s) 140 may be attached to and sent downhole using the deployment tool 110. For example, one or more canister 140 may be built into the deployment tool 110, such that the nozzle(s) of the canister(s) 140 are fluidly connected to the port(s) 118 in the deployment tool 110. The canister(s) 140 may be prefilled with starting chemical composition(s) in an amount that, when reacted, may entirely fill the packer bag 100 with a polymer filler material. Different canister types and injection mechanisms known in the art may be incorporated into the deployment tool 110 without departing from the scope of this disclosure.

According to embodiments of the present disclosure, a packer bag 100 may be filled with a polymer filler material by injecting a self-expanding foam into the packer bag 100. Self-expanding foam may be activated by reacting two or more starting chemical compositions together. Starting chemicals may be held in separate compartments in one or more canisters 140, and when the packer bag 100 is ready to be filled, the starting chemical compositions may be combined and injected into the packer bag 100. When the starting chemicals are combined, they may react and expand. For example, in some embodiments, a first canister having a first starting chemical composition and a second canister having a second starting chemical composition may be provided within the deployment tool 110 (e.g., where the first and second canisters may be separate compartments within canister 140), wherein the first and second starting chemical compositions react to form the polymer filler material. A first starting chemical may include, for example, polyurethane foam, and a second starting chemical may include, for example, a hardening resin. In some embodiments, more than two starting chemical compositions may be mixed together to form a polymer filler material.

In some embodiments, a two part, pre-proportioned polyurethane resin may be used as starting chemical compositions, which when mixed, produces an expanding polymer foam. For example, a first starting chemical composition may include propane-1,2-diol, propoxylated and a second starting chemical composition may include 4,4'-methylenediphenyl diisocyanate, isomers and homologues of diphenylmethanediisocyanate, and o-(p-isocyanatobenzyl)phenyl isocyanate, and when mixed together, form a polyurethane foam. A commercial example of such material is Sika® PostFix.

In some embodiments, a single starting chemical composition such as a spray polyurethane foam may be provided in a canister 140 for injecting into the packer bag 100. Single-component polymer filler material may be stored in a canister as a stable foamable mixture, under pressure, of a polyurethane prepolymer, blowing agents and auxiliary components for producing a polyurethane foam. As the polyurethane composition is dispensed from the canister, it immediately expands to fill the packer bag 100. An example of a spray polyurethane foam composition may include a mixture of prepolymers containing free isocyanate groups (e.g., in the range of 12 to 17 percent by weight), based on reactive components in the foamable composition, which is produced by reacting a polyisocyanate with a polyol blend of at least two polyols having molecular weights ranging from, for example, 500 to 3000 and 500 to 12,000. A spray polyurethane foam may further include adjuvants, a blowing agent, and/or a surfactant (e.g., poly siloxane polyoxyalkylene surfactant). Another example of a spray polyurethane foam composition may include a mixture of a polyisocyanate, and a first and a second polyol (triols and/or diols) provided in a ratio of from 1:6 to 1:2. An excess of isocyanate may be reacted with a polyol blend containing additional components, such as catalysts, surfactants, and fire retardants in the presence of a blowing agent to form a polyurethane prepolymer. When dispensed from the container, the frothed prepolymer reacts with atmospheric moisture to form an open cell foam having 60 percent to 95 percent open cells.

In some embodiments, a polymer filler material may be made from a foamable epoxy resin including one or more of a liquid epoxy resin, a latent curing agent, a foaming agent, a surface active agent, and a rubbery elastomer or a powdery halogen-free thermoplastic resin of 150 μm or less in average particle diameter. Liquid epoxy resins may include, for example, one or more of (1) a diglycidyl ether using bisphenol A, bisphenol F or resorcin as a base, (2) a polyglycidyl ether of a phenolic novolac resin or a cresol novolac resin, (3) a diglycidyl ether of hydrogenated bisphenol A, (4) a glycidylamine type, (5) a linear aliphatic epoxide type and (6) a diglycidyl ester of phthalic acid, hexahydrophthalic acid or tetrahydrophthalic acid, and may be used in combination with a flexible epoxy resin such as ethylene oxide- or propylene oxide-added bisphenol A type epoxy resin, dimer acid type epoxy resin, epoxy-modified NBR or the like in order to impact toughness of the foamed polymer filler material obtained.

Latent curing agents may includes, for example, imidazole derivatives such as dicyandiamide, 4,4'-diaminodiphenyl sulfone, 2-n-heptadceylimidazole and the like; isophthalic acid dihydrazide; N,N-dialkylurea derivatives; N,N-dialkylthiourea derivatives; acid anhydrides such as tetrahydrophthalic anhydride and the like; isophoronediamine; m-phenylenediamine; N-aminoethylpiperazine; boron trifluoride complex compounds; and trisdimethylaminomethylphenol. Such foamable epoxy resins may provide a foamed polymer filler material with rigidity and good heat resistance, having an expansion ratio of 5 times or more and a dense cell structure of 0.5 mm or less in average cell diameter.

A foaming agent may be a high temperature decomposition foaming agent (e.g., having a decomposition temperature of 100°-220° C.) and may include one or more of an organic foaming agent (e.g., azodicarbondiamide, p-toluenesulfonyl hydrazide, dinitrosopentamethylenetetramine, or 4,4'-oxybisbenzenesulfonyl hydrazide) with an optional additive selected from urea, a zinc compound, a lead compound, or the like, an inorganic foaming agent (e.g., sodium hydrogencarbonate or sodium boron hydride), and microcapsules of high-temperature expansion type (e.g., microcapsules having a vinylidene chloride resin and a low-boiling hydrocarbon encapsulated therein).

A surface active agent may include one or more of an anionic surface active agents such as salt of alkyl sulfate (e.g. sodium lauryl sulfate, sodium myristyl sulfate), salt of alkylarylsulfonic acid (e.g. sodium dodecylbenzenesulfonate, potassium dodecylbenzenesulfonate), salt of sulfosuccinic acid ester (e.g. sodium dioctyl sulfosuccinate, sodium dihexyl sulfosuccinate), salt of aliphatic acid (e.g. ammonium laurate, potassium stearate), salt of polyoxyethylene alkyl sulfate, salt of polyoxyethylene alkyl aryl sulfate, salt of resin acid and the like; a non-ionic surface active agent such as sorbitan ester (e.g. sorbitan monooleate, polyoxyethylene sorbitan monostearate), polyoxyethylene alkyl ether, polyoxyethylene alkyl phenyl ether, polyoxyethylene alkyl ester and the like; and a cationic surface active agent such as cetylpyridinium chloride, cetyltrimethylammonium bromide and the like.

A rubbery elastomer starting chemical may be a solid (e.g., a powder) or a highly viscous liquid. A thermoplastic resin starting chemical may be a powder (e.g., having an average particle diameter of 150 μm or less). Elastomer and thermoplastic resin starting chemicals may include an elastomer or resin capable of being melted to form an intimate mixture with another starting chemical (e.g., an epoxy resin) and further capable of maintaining the melt viscosity of the composition stably. Such an elastomer or resin may include one or more rubbery elastomers such as chloroprene rubber, butadiene-acrylonitrile rubber, carboxyl-modified butadiene-acrylonitrile rubber, epoxy-modified butadiene-acrylonitrile rubber, butadiene rubber, isoprene rubber and the like, and thermoplastic resins such as ethylene-vinyl acetate copolymer, polyphenylene ether, ethylene-vinyl alcohol copolymer, acrylonitrile-styrene copolymer, polyamide, polyvinyl butyral, polyvinyl acetal, polymethyl methacrylate, acrylonitrile-butadiene-styrene copolymer, methyl methacrylate-butadiene-styrene copolymer, polystyrene and the like.

An epoxy resin diluent may optionally be added to allow better mixing of an epoxy resin. Diluents may be selected, for example, from one or more of reactive diluents, such as butyl glycidyl ether, allyl glycidyl ether, phenyl glycidyl ether, and cresyl glycidyl ether, and non-reactive diluents such as dibutyl phthalate, dioctyl phthalate, butyl benzyl phthalate, tricresyl phosphate, acetyl tributyl citrate, aromatic process oil, pine oil, and 2,2,4-trimethyl-1,3-pentanediol diisobutyrate.

In some embodiments, a plasticizer may be added to one or more starting chemical compositions of a polymer filler material. A plasticizer may be selected, for example, from one or more of phthalic acid ester (e.g. dioctyl phthalate, dibutyl phthalate), phosphoric acid ester (e.g. tricresyl phosphate), aliphatic acid ester (e.g. dioctyl adipate), adipic acid condensate of ethylene glycol, trimellitic acid triester, glycol acid ester, chlorinated paraffin, and alkylbenzene.

After injecting the polymer filler material inside the packer bag 100 to expand the packer bag 100 into a fully inflated packer, the polymer filler material may cure or harden in a curing time period. In some embodiments, after reacting and expanding, a polymer filler material may cure or harden in a curing time period of less than 1 hour, less than 30 minutes, less than 15 minutes, less than 10 minutes, or less than 5 minutes, depending on the composition of the polymer filler material.

In some embodiments, a heating element 150 may be incorporated into the downhole tool assembly 120 and positioned proximate the packer bag 100 to heat polymer filler material as it is injected into the packer bag 100. In some embodiments, a heating element may be positioned around the ports of the deployment tool and/or around the canister(s) containing the starting chemical(s) to heat polymer filler material as it is injected into the packer bag 100.

Heating the polymer filler material as it is injected into the packer bag 100 may help speed up expansion of the polymer filler material, which may ensure a complete fill of the packer bag 100. Heating elements 150 may include any known type of downhole heater, e.g., induction heating coils or an electric heater, and may be powered, for example, with batteries or from a connected power source at the surface of the well. Operation of the heating element 150 may be automatically triggered during mixing and/or injecting the polymer filler material. In some embodiments, a signal to initiate heating may be sent wirelessly to the heating element or through a control line extending from the heating element 150 to the surface of the well. Further, in some embodiments, the temperature of the heating element 150 may be controlled from the surface of the well (e.g., through wireless control signals or through a control wire) or a heating temperature sequence may be pre-programed to optimize heating and expanding the polymer filler material being used.

The deployment tool 110 may have a tubular body, and may include, for example, a liner, coiled tubing, or a downhole tractor. As a non-limiting example, the deployment tool 110 shown in FIGS. 1-4 may be a liner, where the packer bag 100 may be helically wound around a partial axial length of the liner and a circumferential distance 101 around the liner greater than the circumference of the liner. The wrapped liner may be sent to an open hole (134) portion of a well 130 to position the packer bag 100 to seal a section of the open hole well. As shown in FIGS. 3 and 4, when filled with a polymer filler material, the size and shape of the packer bag 100 may expand to fill an entire annular space between the well wall 134 and the deployment tool 110, forming a fluid tight seal between portions of the well on opposite axial sides of the inflated packer bag 100. Further, as best shown in FIG. 3, the packer bag 100 may keep a generally helical shape around the deployment tool 110 when in a fully inflated configuration, where adjacent sides between helical turns in the packer bag 100 may contact each other in a sealing engagement.

Figure 5:
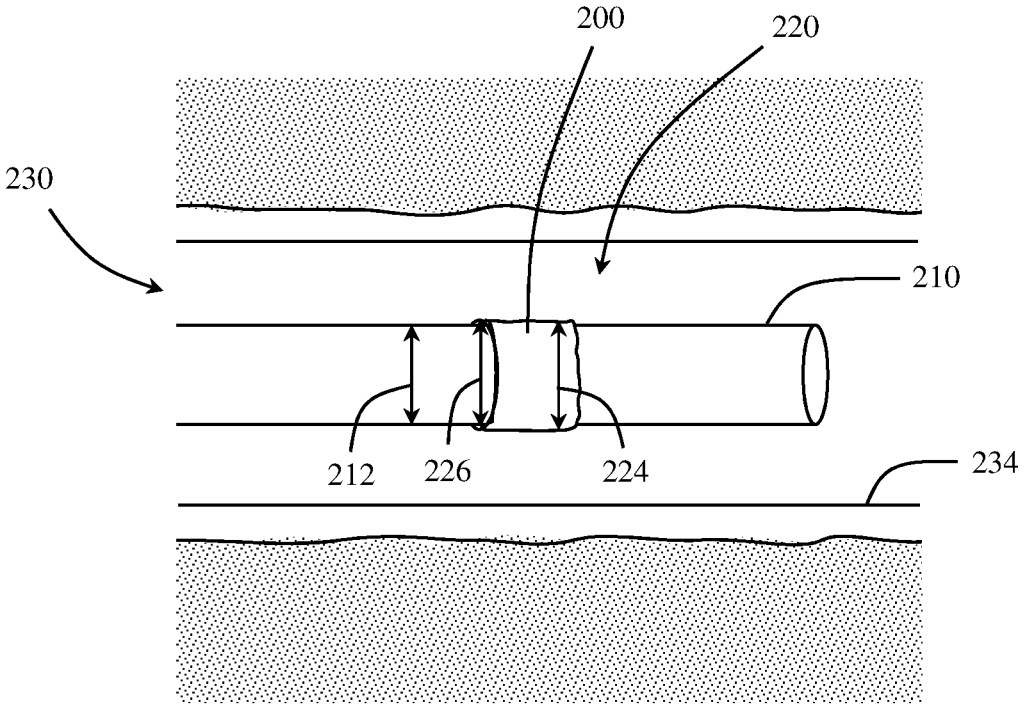
FIG. 5 shows a deflated packer bag wrapped around a deployment tool according to embodiments of the present disclosure.
Figure 6:
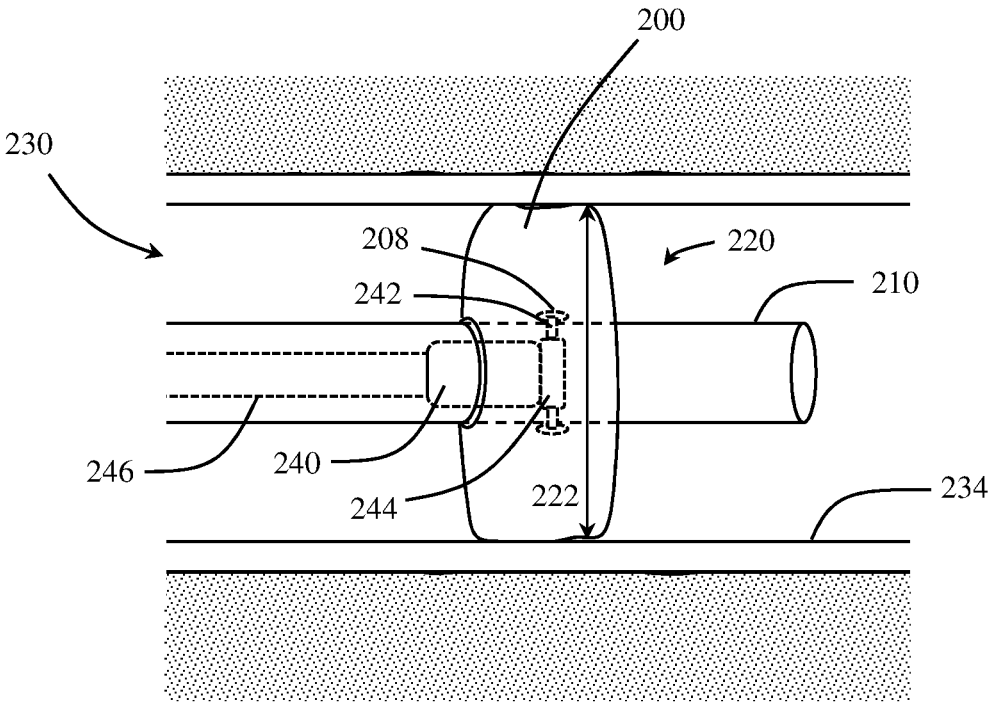
FIG. 6 shows the downhole tool assembly of FIG. 5 having the packer bag in an inflated configuration according to embodiments of the present disclosure.

Referring now to FIGS. 5 and 6, another example of a downhole tool assembly 220 is shown being deployed in a cased portion of a well 230. A packer bag 200 may be wrapped tightly around a deployment tool 210 and sent to a downhole location in a deflated, collapsed configuration, as shown in FIG. 5. Once in the selected downhole location, the packer bag 200 may be filled with a polymer filler material to radially expand until the inflated packer bag 200 contacts the well wall 234 and seals the annular space between the deployment tool 210 and well wall 234, as shown in FIG. 6.

The packer bag 200 may have a toroidal shape, extending entirely around the circumference of the deployment tool 210. A toroidal-shaped packer bag 200 may be wrapped around the deployment tool 210 by sliding the packer bag 200 around the deployment tool 210. For example, similar to a rubber band, a toroidal-shaped packer bag 200 in a deflated configuration may be stretched to fit an inner diameter 226 of the toroidal-shaped packer bag 200 around the outer surface of the deployment tool 210. When the stretched packer bag 200 is positioned around the deployment tool 210 in a selected location, the packer bag 200 may be released to tightly fit around the deployment tool 210.

In some embodiments, a deflated packer bag 200 does not need to be stretched in order to fit around and be positioned along a selected location of the deployment tool 210. For example, in such embodiments, a deflated packer bag 200 may have a toroidal shape with an inner diameter 226 that is slightly greater than an outer diameter 212 of the deployment tool 210, such that the packer bag 200 may be slipped or rolled around the deployment tool 210, but have little or no independent movement around the deployment tool 210 after being moved into the selected location around the deployment tool 210. In some embodiments, at least one axial stopper (e.g., a pin or clip) may be provided on an outer surface of the deployment tool 210 around at least one axial side of the packer bag 200 to help prevent axial movement of the packer bag 200 along the deployment tool 210.

As shown in FIG. 6, a canister 240 containing at least one polymer filler starting composition (e.g., polyurethane foam) may be fluidly connected to the packer bag 200 via one or more nozzles 242 directed into fluid openings 208 formed through an inner diameter 226 of the packer bag 200. The canister 240 may be sent downhole on a running tool 246, which may be run from the surface of the well 230 through a central bore in the deployment tool 210 to axially align with the packer bag 200. In some embodiments, the canister 240 may be fluidly connected to the fluid openings 208 in the packer bag 200 prior to sending the downhole tool assembly 220 to the downhole location. When the nozzles 242 are fluidly connected to the fluid openings 208 in the packer bag 200 and in the downhole location, a release mechanism 244 (e.g., a valve) in the canister 240 may be activated (e.g., via an electric signal, hydraulically activated, or with a ball drop) to open the canister 240 and release the polymer filler starting composition(s) into the packer bag 200.

When the polymer filler material is injected into the packer bag 200, the packer bag 200 may expand to an expanded outer diameter 222 greater than 2 times a contracted outer diameter 224 measured between the wrapped packer bag prior to injecting the polymer filler material. In some embodiments, the expanded outer diameter 222 may be greater than 3 times the contracted outer diameter 224 of the packer bag 200.

After filling the packer bag 200 with polymer filler material and allowing the polymer filler material to cure, the running tool 246 and connected canister 240 may be disconnected from the downhole tool assembly 220 and brought back to the surface of the well 230. In some embodiments, the running tool 246 may be disconnected from the canister 240, leaving the canister 240 connected to the deployment tool 210.

Methods of sealing a section of a well according to embodiments of the present disclosure may include deploying a collapsed packer bag around an outer surface of a deployment tool to a downhole location, providing at least one canister containing a polymer filler starting composition in fluid communication with the packer bag, and injecting a polymer filler material from the at least one canister into the packer bag until the packer bag expands to seal the downhole location.

The canister(s) may be removably connected to the deployment tool, allowing the canister(s) to be removed after sealing the well. For example, after waiting a curing time for the polymer filler material to cure within the packer bag, the canister may be removed, for example using a running tool or a fishing tool.

Methods of sealing a section of a well using inflatable packers disclosed herein may be used for a variety of downhole operations, including, for example, zonal isolation and well segmenting operations, downhole testing and repairs, and hydrocarbon recovery operations.

Figure 7:
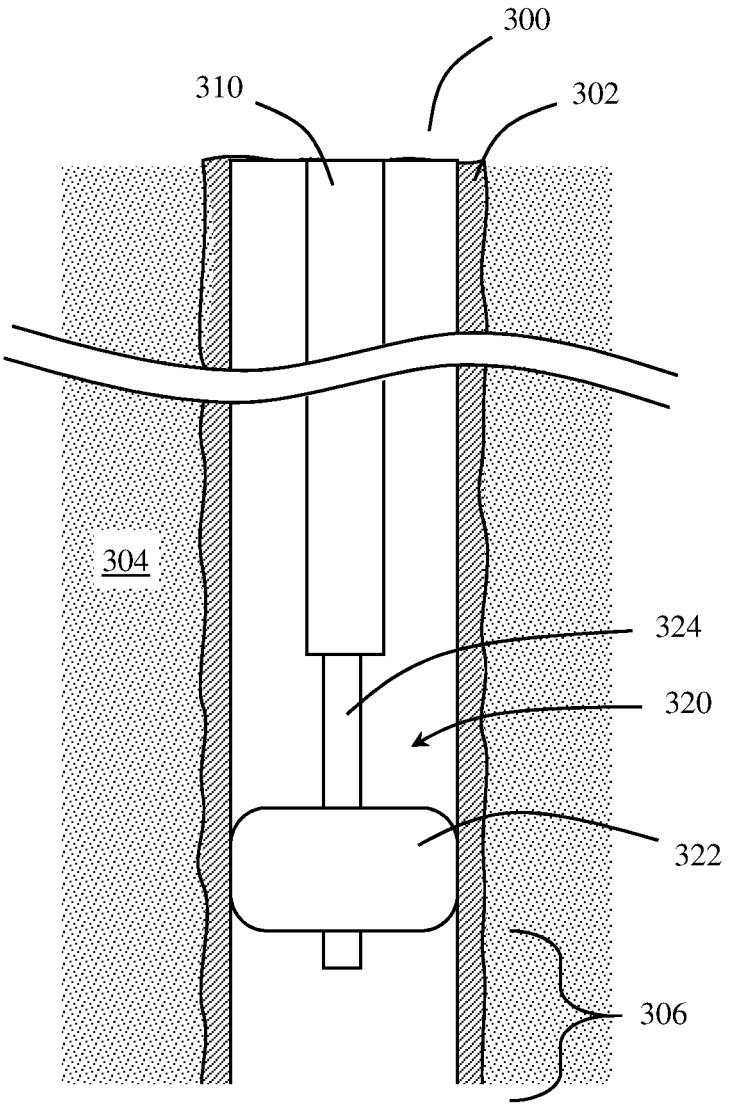
FIG. 7 shows a downhole tool assembly deployed in a well according to embodiments of the present disclosure.

In an example shown in FIG. 7, a well 300 may be lined with a casing 302 and extend through a formation 304. Production tubing 310 may extend from the surface of the well 300, which may be used, for example, to flow fluids recovered from the formation 304 to the surface of the well 300. According to embodiments of the present disclosure, a downhole tool assembly 320 having a packer bag 322 wrapped around the outer surface of a deployment tool 324 may be sent through the production tubing 310 to seal a section 306 of the well 300 below the production tubing 310. For example, the section 306 of the well 300 may be sealed in order to treat the formation 304 with chemicals (e.g., by pumping the chemicals through the production tubing 310 and/or deployment tool 324), where the treatment chemicals may be pumped through perforations in the casing 302 to reach and treat the formation 304.

The deployment tool 324 may be coiled tubing that may be run from the surface of the well 300 through the production tubing 310, for example, from a coiled tubing storage reel, using a guide, injector assembly, pump(s) for circulating fluids through the coiled tubing, and/or valves for controlling pressure through the well. The coiled tubing deployment tool 324 may have a collapsed packer bag wrapped around an end of the coiled tubing. In the collapsed configuration, the packer bag may fit through production tubing 310 having an inner diameter of less than 5 inches (e.g., a 4.5 inch inner diameter or 2.5 inch diameter). When positioned in the selected downhole location, a polymer filler material may be injected into the packer bag 322 (e.g., from one or more canisters provided within the coiled tubing deployment tool 310) to fill and expand the packer bag 322 to an inflated configuration. The packer bag 322 may be inflated to an expanded outer diameter that reaches and seals against the inner diameter of the casing 302. For example, the packer bag 322 may be filled with a polymer filling material to expand and seal against a casing 302 having an inner diameter of about 6.5 inches or greater. In such embodiments, the expansion ratio of the packer bag 322 may be approximately 3:1 or more.

When the section of the well 300 no longer needs to be sealed (e.g., operations conducted while the section 306 of the well is sealed, such as formation treatment and/or testing operations, is completed), one or more removal procedures may be conducted. For example, the inflated packer bag 322 may be drilled through, the coiled tubing deployment tool 324 may be disconnected from the inflated packer bag 322 and brought back to the surface, and/or a canister may be removed from within the coiled tubing deployment tool 324.

Downhole tool assemblies according to embodiments of the present disclosure may be used to deploy highly expandable packers through slim tubing (e.g., production tubing) to expand within and seal larger cased or uncased portions of a well. For example, methods and downhole tool assemblies disclosed herein may be used to set a packer in a washed out portion of a well (e.g., where a portion of a borehole wall has been eroded or washed away).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole tool assembly, comprising:
a deployment tool;
a packer bag wrapped around an outer surface of the deployment tool, the packer bag comprising:
a flexible composite wall;
a single skeleton wire attached to a portion of the flexible composite wall proximate the outer surface of the deployment tool and securing a remaining portion of the packer bag around the deployment tubing; and
wherein the flexible composite wall forms a fully enclosed bag having at least one fluid opening; and
at least one canister containing at least one polymer filler starting composition, the at least one canister being fluidly connected to the at least one fluid opening.

2. The downhole tool assembly of claim 1, wherein the skeleton wire is integrally formed with the flexible composite wall.

3. The downhole tool assembly of claim 1, wherein the packer bag is wrapped a circumferential distance around the deployment tool greater than a circumference of the deployment tool.

4. The downhole tool assembly of claim 1, wherein the packer bag is uncovered around the deployment tool.

5. The downhole tool assembly of claim 1, wherein flexible composite wall comprises a material selected from a thermoplastic composite reinforced with aramid, thermoplastic polyurethane, and an elastomer.

6. The downhole tool assembly of claim 1, wherein the at least one canister is removably connected to the deployment tool.

7. The downhole tool assembly of claim 1, wherein the packer bag protrudes a thickness from the outer surface of the deployment tool less than 1 inch.

8. The downhole tool assembly of claim 1, wherein a cured polymer filler material is held inside the packer bag.

9. A downhole tool assembly, comprising:
a deployment tool;
a packer bag wrapped around an outer surface of the deployment tool, the packer bag comprising:
a flexible composite wall;
a skeleton wire attached to the flexible composite wall and securing the packer bag around the deployment tubing; and
wherein the flexible composite wall forms a fully enclosed bag having at least one fluid opening; and
at least one canister containing at least one polymer filler starting composition, the at least one canister being fluidly connected to the at least one fluid opening,
wherein the at least one canister contains polyurethane foam.

* * * * *